US008186731B1

(12) United States Patent
Romero et al.

(10) Patent No.: US 8,186,731 B1
(45) Date of Patent: May 29, 2012

(54) TAMPER INDICATING SEAL

(75) Inventors: Juan A. Romero, Albuquerque, NM (US); Charles A. Walker, Albuquerque, NM (US); Dianna S. Blair, Albuquerque, NM (US); Connie C. Bodmer, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 384 days.

(21) Appl. No.: 12/423,263

(22) Filed: Apr. 14, 2009

(51) Int. Cl.
*B65D 55/06* (2006.01)
*B65D 33/34* (2006.01)

(52) U.S. Cl. ..... 292/307 R; 292/307 B; 292/315; 292/320; 292/324

(58) Field of Classification Search ..... 292/307 R, 292/307 A, 307 B, 315–318, 320–326; 70/50; 24/573.09, 581.1
See application file for complete search history.

(56) References Cited

U.S. PATENT DOCUMENTS

| | | | | | |
|---|---|---|---|---|---|
| 1,122,872 | A | * | 12/1914 | Dinsmoor | 292/325 |
| 1,683,015 | A | * | 9/1928 | Barbour et al. | 292/307 R |
| 1,977,301 | A | | 1/1933 | Bradford | |
| 1,930,560 | A | * | 10/1933 | Keidel | 292/318 |
| 2,006,051 | A | * | 6/1935 | Keidel | 292/328 |
| 2,140,320 | A | * | 12/1938 | Keidel | 292/318 |
| 2,144,336 | A | * | 1/1939 | Katz | 206/776 |
| 2,356,856 | A | * | 8/1944 | Komenak | 292/318 |
| 2,750,220 | A | * | 6/1956 | Keidel | 292/323 |
| 2,809,065 | A | | 10/1957 | Erke | |
| 3,107,935 | A | * | 10/1963 | Erke | 292/325 |
| 4,118,057 | A | | 10/1978 | Ryan | |
| 5,184,747 | A | | 2/1993 | Nolte | |
| 5,647,620 | A | | 7/1997 | Kuenzel | |
| 5,762,386 | A | | 6/1998 | Fuehrer | |
| 5,871,243 | A | | 2/1999 | Wenk | |
| 6,000,736 | A | * | 12/1999 | Leon et al. | 292/326 |
| 6,131,969 | A | | 10/2000 | Natkins | |
| 6,174,006 | B1 | * | 1/2001 | Burt | 292/307 A |
| 6,390,519 | B1 | * | 5/2002 | Dreisbach et al. | 292/307 R |
| 6,494,508 | B1 | * | 12/2002 | Dreisbach et al. | 292/307 R |
| 6,578,886 | B1 | | 6/2003 | Bystry et al. | |
| 6,588,812 | B1 | * | 7/2003 | Garcia et al. | 292/307 R |
| 6,888,241 | B1 | * | 5/2005 | Korn et al. | 257/728 |
| 7,690,091 | B2 | * | 4/2010 | Stobbe | 24/704.1 |

OTHER PUBLICATIONS

Johnston, R.G., "Assessing the Vulnerability of Tamper-Indicating Seals", Invited Article for Prot Technology International 25, 155-156 (2005).

Johnston, R.G., "Tamper-Indicating Seals for Nuclear Disarmament and Hazardous Waste Management", Science & Global Security, vol. 9, pp. 93-112, (2001).

* cited by examiner

*Primary Examiner* — Carlos Lugo
(74) *Attorney, Agent, or Firm* — William R. Conley; Kevin W. Beig

(57) ABSTRACT

Seals have a flexible wire that can be looped through a hasp-like device. The seals include a body having a recess, a plug insertable into the recess and a snap ring for fastening the plug to the body. The plug and/or body can have access holes for inserting the wire into the recess. "Teeth" on the outer diameter and through-holes through the thickness of the snap ring allow for passing the ends of the flexible wire from the recess through the snap ring. The ends of the wire can be folded back over the snap ring and into engagement with the teeth. Assembly of the seal causes the ends of the wire to be securely fastened between the teeth of the snap ring and the sidewall of the recess. Seals can include a plug and/or body made of a frangible material such as glass, ceramic, glass-ceramic or brittle polymer.

30 Claims, 12 Drawing Sheets

TAMPER INDICATING SEAL

STATEMENT REGARDING FEDERALLY SPONSORED RESEARCH OR DEVELOPMENT

The United States Government has certain rights in this invention pursuant to Department of Energy Contract No. DE-AC04-94AL85000 with Sandia Corporation.

FIELD OF THE INVENTION

The invention generally relates to tamper indicating seals. The invention further relates to tamper indicating seals of the passive type, having a flexible wire secured within a tamper indicating frangible body assembly.

BACKGROUND OF THE INVENTION

Tamper indicating seals of the passive wire type are typically used in combination with a form of lock and hasp arrangement, wherein the wire of the seal is threaded through the hasp and then secured within the body of the seal. Any attempt to remove the seal can ideally be readily observed in the field as visible alterations to the seal body or wire itself. Unlike active tamper indicating seals, seals of the passive variety require no power source nor contain electronic components. Seals can additionally include anti-counterfeiting features such as serial numbers and unique patterns or features incorporated into the structure of the seal. Seals of the present invention can for example be deployed to detect unauthorized access or tampering to hazardous areas or containers, commercial trade shipping containers, high value and/or security areas and materials. Available seals are typically manufactured from inexpensive polymeric materials (e.g. resins and/or plastics) and or metals and are susceptible to degradation in extreme environments (e.g. temperature, chemical, and biological) and are susceptible to undetectable tampering due to the malleability of the materials used. What are needed are seals that are robust to elevated temperature, chemical and biological attack, and seals manufacturable of frangible (e.g. brittle) materials that can be readily inspected without special equipment, for the slightest attempts at tampering. What are additionally needed are seals that are quick and easy to assemble in the field without the need for special tools.

BRIEF DESCRIPTION OF THE DRAWINGS

The accompanying drawings, which are incorporated in and form part of the specification, illustrate several embodiments of the present invention and, together with the description, serve to explain the principles of the invention. The drawings provided herein are not drawn to scale.

DETAILED DESCRIPTION OF THE INVENTION

Tamper indicating seals of the passive wire type are typically used in combination with a form of lock and hasp arrangement, wherein the wire of the seal is threaded through the hasp and then secured within the body of the seal. Any attempt to remove the seal can ideally be readily observed in the field as visible alterations to the seal body or wire itself. Unlike active tamper indicating seals, seals of the passive variety require no power source nor contain electronic components. Passive seals can additionally include anti-counterfeiting features such as serial numbers and unique patterns or features incorporated into the structure or materials of the seal. Seals of the present invention can for example be deployed to detect unauthorized access or tampering to hazardous areas or containers, commercial trade shipping containers, high value and/or security areas and materials. See for example: Johnston, R. G., "Tamper-Indicting Seals for Nuclear Disarmament and Hazardous Waste Management", Science & Global Security, Vol. 9, pp. 93-112, 2001, the entirety of which is incorporated herein by reference.

Figure 1:
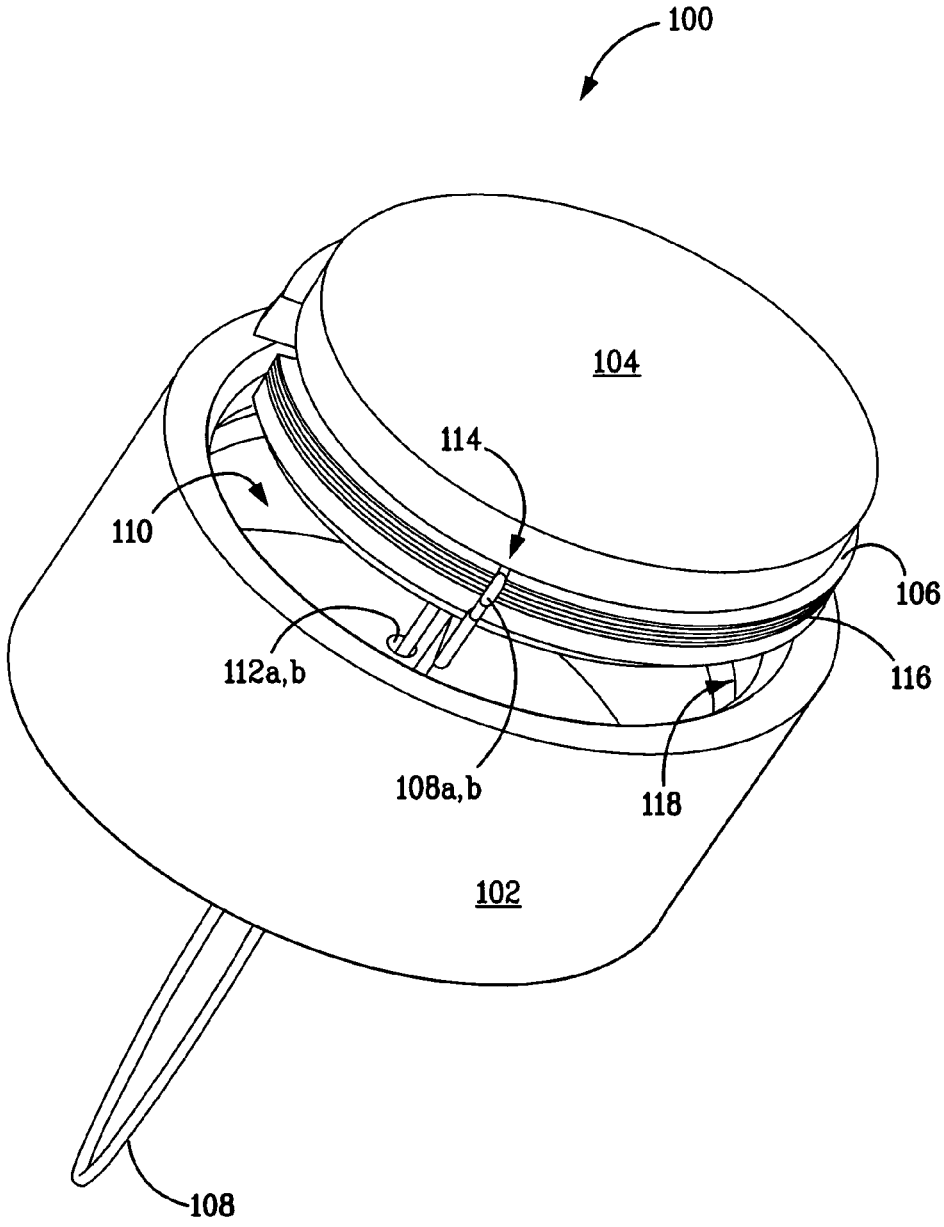
FIG. 1 is a schematic illustration of a partially assembled embodiment of a seal according to the present invention.

FIG. 1 is a schematic illustration of a partially assembled embodiment of a seal according to the present invention. Passive tamper indicating seal 100, includes a body 102 having a recess 110 into which a plug 104 (e.g. cap) is inserted and secured by means of a snap ring 106. A flexible wire 108 can be looped through a hasp or similar feature of a container or other device to be sealed (not shown) and the free ends 108*a,b* of the wire 108 threaded through access holes 112*a,b* in the body 102 and secured within the seal 100 by the action of the snap ring 106 (as described below). The ends 108*a,b* of the wire 108 can be inserted into through-holes 114 through the thickness of the snap ring and folded back over serrations 116 (e.g. notches, gear teeth) machined into the outer diameter of the snap ring 106. Assembly of the seal 100 by pressing the plug 104 into the recess 110 engages the snap ring 106 with mating groove 118 in the body 102 of the seal 100 and fastens the plug 104 to the body. Ends 108*a,b* of the wire 108 are captured between the serrations 116 of the snap ring 106 and the sidewall of the recess 110. The assembly is irreversible in that the plug 104 cannot be removed from the body 102 without causing visible damage (e.g. scratches, chips, cracks etc.) to either of the plug 104, body 102, snap ring 106 or wire 108.

Figure 2:
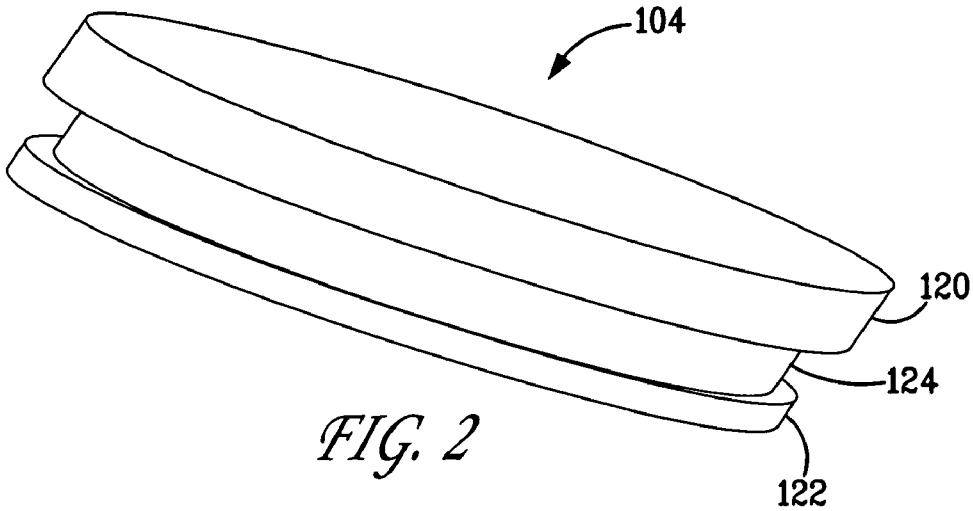
FIG. 2 is an enlarged view of the embodiment of a plug from FIG. 1.

FIG. 2 is an enlarged view of the embodiment of a plug from FIG. 1. Plug 104 is preferably manufactured from a frangible (e.g. brittle) material such as a ceramic, glass, glass-ceramic or brittle polymer that is easily scratched, chipped and/or cracked, if attempts are made to tamper (e.g. disassemble) the seal for example, by insertion of a tool (not shown) into the area of the snap ring. A groove 124 can be produced (e.g. machined, cast, molded) in the sidewall of the plug 104 for capturing the snap ring. It is not critical to the practice of the invention that the snap ring and/or the groove 124 extend completely around the circumference of the plug 104, as snap rings typically have a gap in their circumference to facilitate assembly. Plug 104 can comprise an "upper" portion 120 and a "lower" portion 122 having differing outer diameters, wherein this instance, the lower portion 122 can have a lesser diameter than the upper portion 120 to facilitate insertion of the plug 104 into the recess 110 in the body 102. Here, the terms upper and lower merely refer to those portions of the plug 104 facing externally of the seal 100 and into the recess 110. In the present example, the plug 104 is dimensioned to be contained within the recess 110 and provide a gap between the bottom surface of the plug 104 and the floor of the recess 110 to facilitate wire assembly, but these dimensions are not critical to the practice of the invention. For example, it can be desirable in some applications for the plug 104 to extend outwardly, beyond the extents of the body 102 of the seal.

Figure 3:
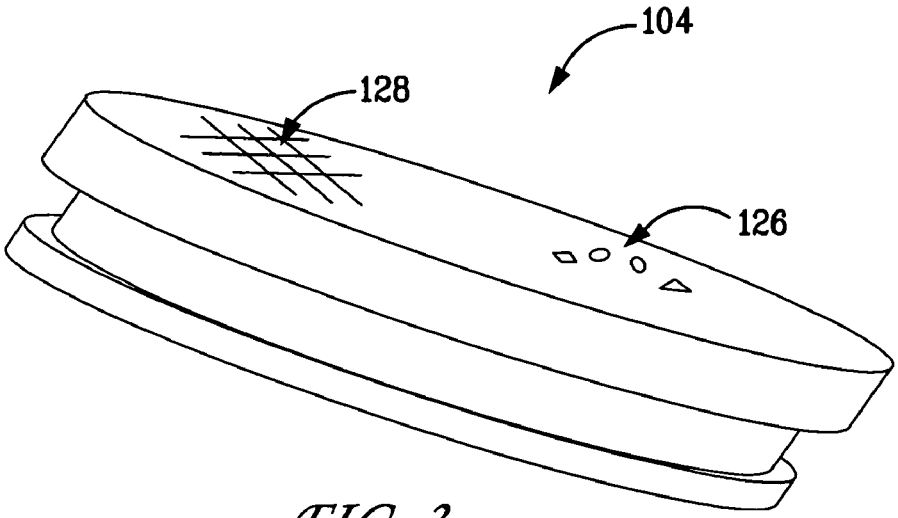
FIG. 3 is an enlarged view of the embodiment of the plug from FIG. 1, with anti-counterfeiting features.

FIG. 3 is an enlarged view of the embodiment of the plug from FIG. 1, with anti-counterfeiting features. It can be desirable in some applications to include anti-counterfeiting features into the plug 104 (and/or body 102) of a seal. Embodiments of the present invention provide convenient means for inclusion of anti-tampering features such as inclusion of particulates having randomly produced and therefore uniquely recognizable patterns in the surface of the plug 104. In the exemplary embodiment, particles 126 can comprise high temperature metallic or oxide inclusions added to the glass, glass-ceramic, ceramic or polymer materials at the time of mixing, pressing, firing, molding or casting. These particles can be visible from the top surface of the plug 104 and would by randomness, produce a unique pattern in the surface of each plug 104 produced. The size, shape, distribution and pattern of the particulates 126 can be recorded photographically (e.g. visually) for later comparison to the fielded seal as an anti-counterfeiting measure. Additionally, scratches, scribings or other markings 128 produced on a surface (e.g. top or sidewalls) of the plug 104 could as well be recorded at the time of manufacture or deployment of a seal for later comparison to the fielded seal as an anti-counterfeiting measure. Other markings such as serial numbers and/or date codes can be included as well as an application merits.

Figure 4:
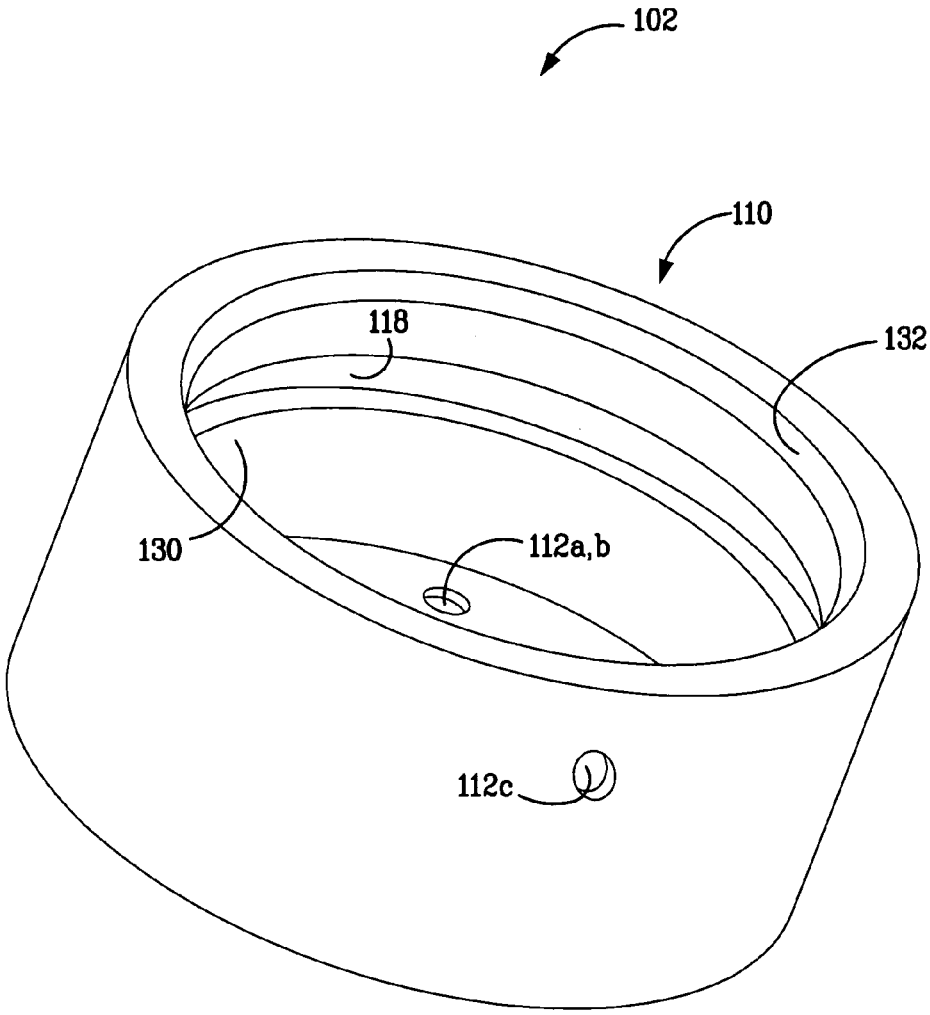
FIG. 4 is an enlarged view of the embodiment of a body from FIG. 1.

FIG. 4 is an enlarged view of the embodiment of a body from FIG. 1. Body 102 is preferably manufactured from a frangible (e.g. brittle) material such as a ceramic, glass, glass-ceramic or brittle polymer that is easily scratched, chipped and/or cracked, if attempts are made to tamper (e.g. disassemble) the seal for example, by insertion of a tool (not shown) into the area of the snap ring. A groove 118 can be produced (e.g. machined, cast, molded) in the sidewall 130 of the recess 110 for capturing a snap ring. It is not critical to the practice of the invention that the snap ring and/or groove 118 extend completely around the circumference of the recess 110, as snap rings typically have a gap in their circumference to facilitate assembly. A taper 132 can be included in the sidewall 130 of the recess 110 to facilitate assembly of a plug into the recess 110. Access holes 112*a,b* can be disposed in the floor of the recess 110 to allow threading the wire ends into the recess, or can as well be disposed through the sidewall of the body, at 112*c* for example, depending on the particular needs of an application.

Figure 5:
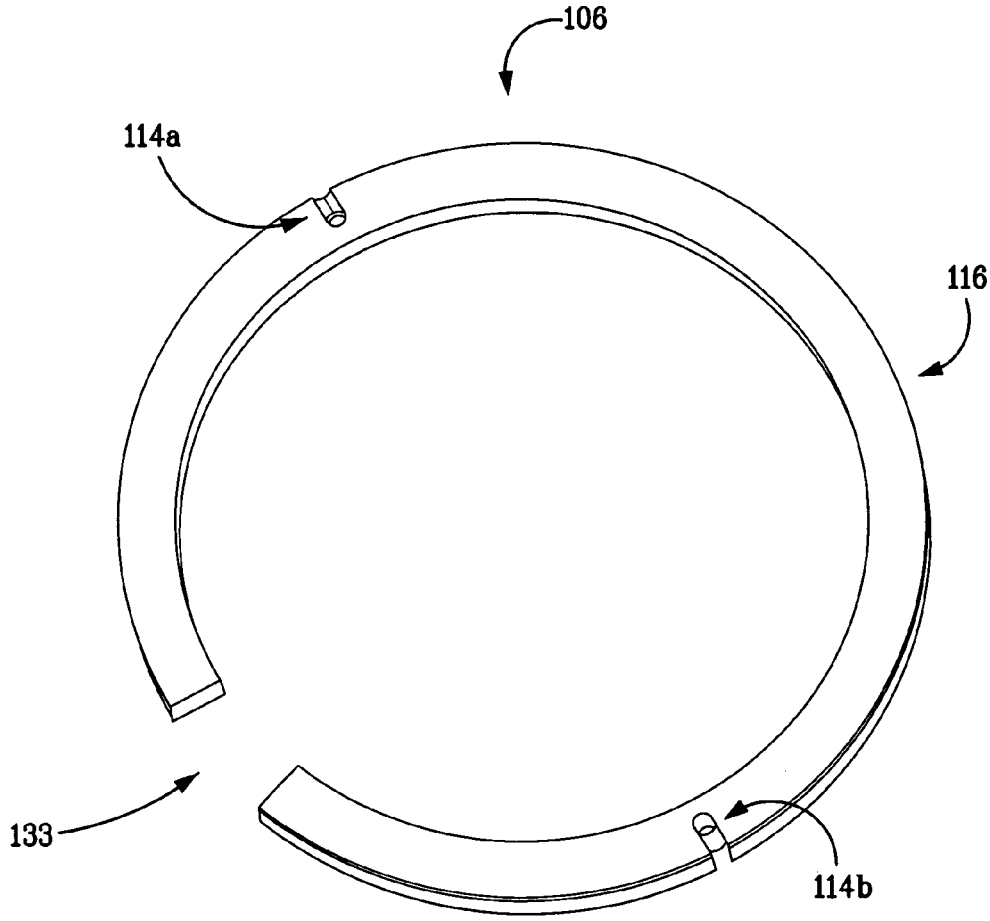
FIG. 5 is an enlarged view of the embodiment of a snap ring from FIG. 1.

FIG. 5 is an enlarged view of the embodiment of a snap ring from FIG. 1. Snap ring 106 can typically be made from a flexible material (e.g. metals including mild steel, stainless steel, nickel, copper etc.) or could as well comprise a polymeric material as an application warranted. Snap ring 106 can have a gap 133 in its perimeter to facilitate assembly. Snap ring 106 has through-holes 114*a,b* disposed through its thickness for threading the ends of a wire from the recess of the body through the snap ring 106. In this example, the through-holes 114*a,b* are disposed approximately 180 degrees apart on the snap ring 106, but the location of the through-holes can be arranged as desired for an application. Serrations 116 comprising at least one "notch" are disposed on the outer circumference of the snap ring 106.

Figure 6:
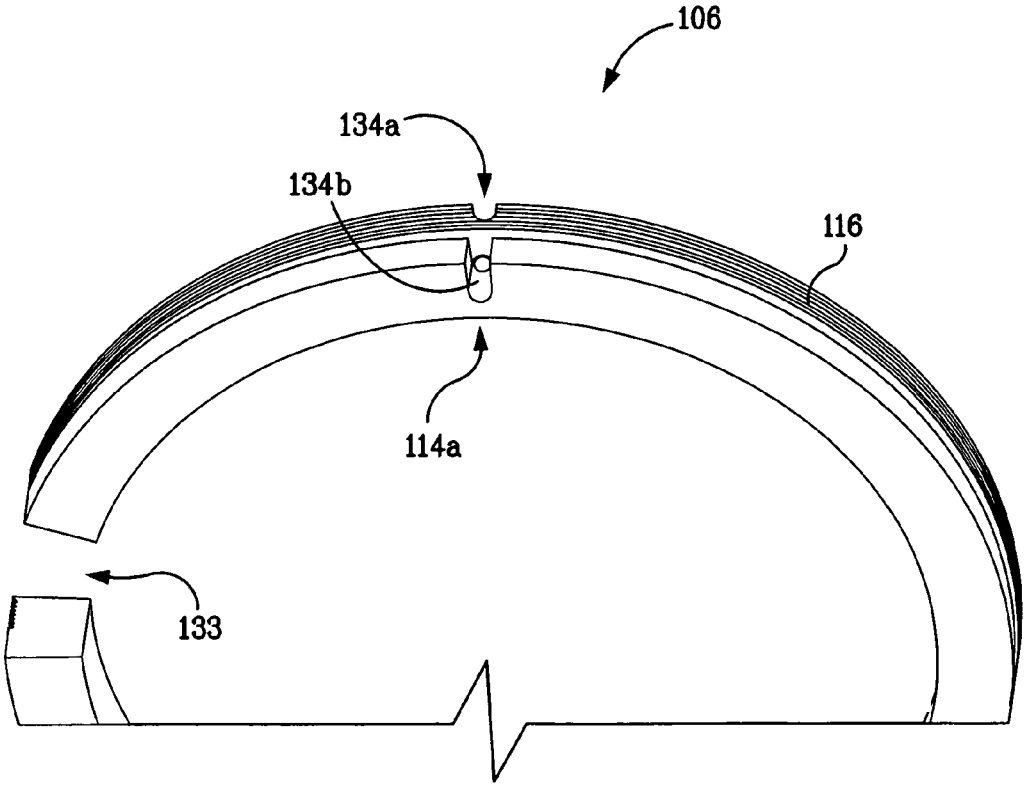
FIG. 6 is a second enlarged view of the embodiment of a snap ring from FIG. 1.

FIG. 6 is a second enlarged view of the embodiment of a snap ring from FIG. 1. In this example, snap ring 106 includes serrations 116 as a series of circumferentially extending notches around approximately one-half of the thickness of the snap ring 106. Through-hole 114*a* is shown for passing the end of the wire through the thickness of the snap ring 106. In a typical application, the ends of the wire are passed through the through-holes and folded back over the outside diameter of the snap ring, thus engaging the wire with the serrations 116 on the snap ring 106. To facilitate the assembly of the seal, wire and snap ring, clearance notches 134*a,b* (e.g. "pockets" or "clearances") can be provided at the outer diameter of the snap ring 106 and be disposed adjacently to the through-holes in the top and bottom surfaces of the snap ring 106. As described below, these features help to facilitate the ease of assembly of a seal, and ensure engagement of the serrations into the wire.

Figure 7:
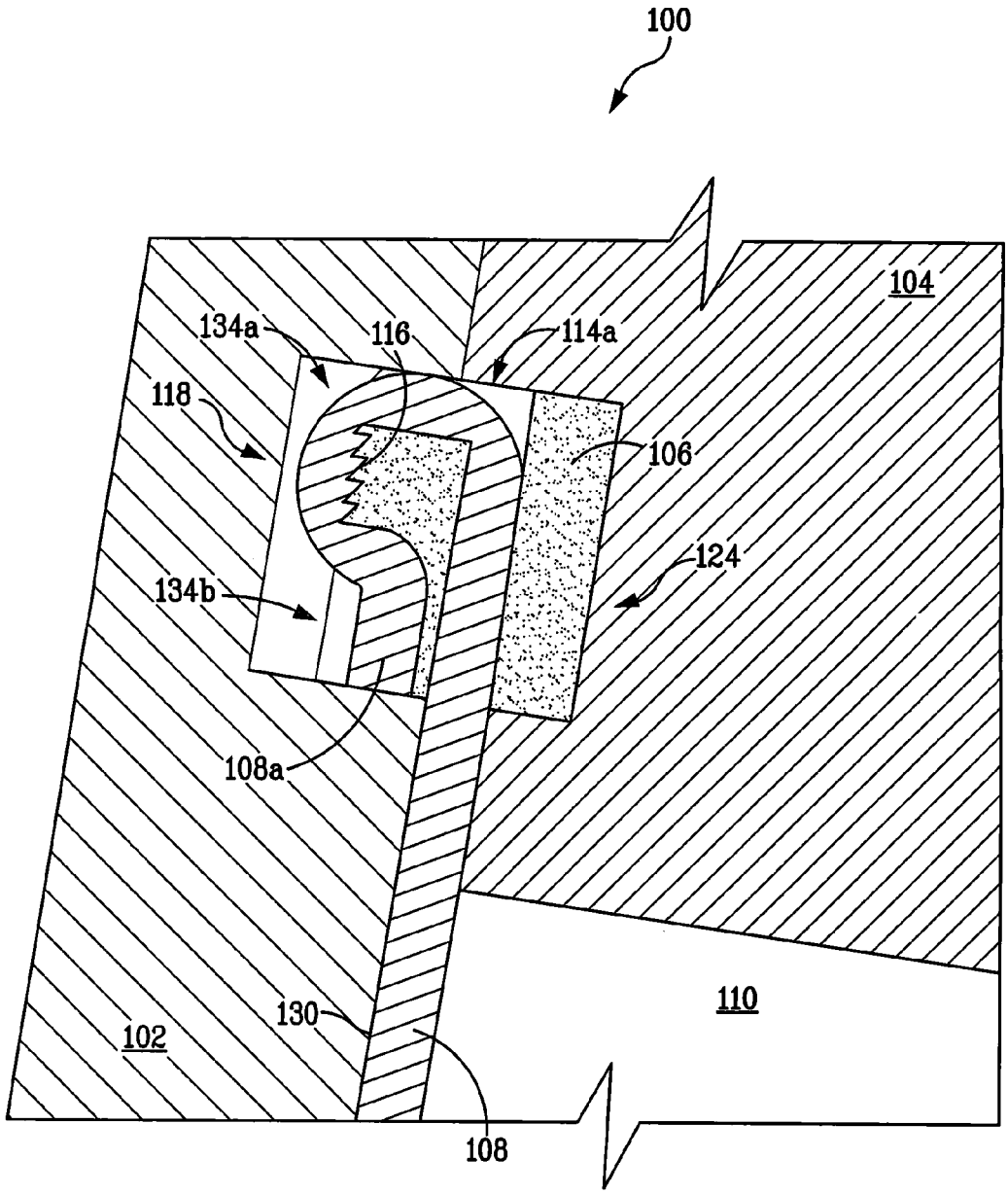
FIG. 7 is an enlarged cross-sectional view of the snap ring region of the embodiment of a seal from FIG. 1, in an assembled state.

FIG. 7 is an enlarged cross-sectional view of the snap ring region of the embodiment of a seal from FIG. 1, in an assembled state. In this view, an end 108*a* of the flexible wire 108 has been threaded from the recess 110 within the body 102 through the through-hole 114*a* in snap ring 106, and has been folded back over the serrations 116 on the outer diameter of the snap ring 106. Assembly of the plug 104 into the recess 110 forces the engagement of the serrations 116 into the wire 108, thereby securely fastening the ends of the wire in the body 102 of the seal 100. The groove 118 in the sidewall 130 of the recess 110 and the corresponding groove 124 in the sidewall of the plug 104 are dimensioned to ensure a close fit and compression of the folded end of the wire between the serrations 116 and the sidewall of the groove 118. The snap ring 106 and grooves 118 and 124 are further dimensioned to ensure that as assembled, the snap ring spans the gap between the body and the plug, i.e. a portion of the width of the snap ring is supported at all times on a "ledge" of the groove 118 and a portion of the width of the snap ring is supported by a ledge of the groove 124. In the present figure, the serrations 116 are illustrated as pointing "downward", i.e. in a direction to facilitate engagement of serrations 116 with wire 108 upon attempts to forcibly pull the wire from the seal 100. It is anticipated that variations and combinations of serrations including extending straight out (or even "upwardly") from the outer diameter of the snap ring could work as well.

Figure 8:
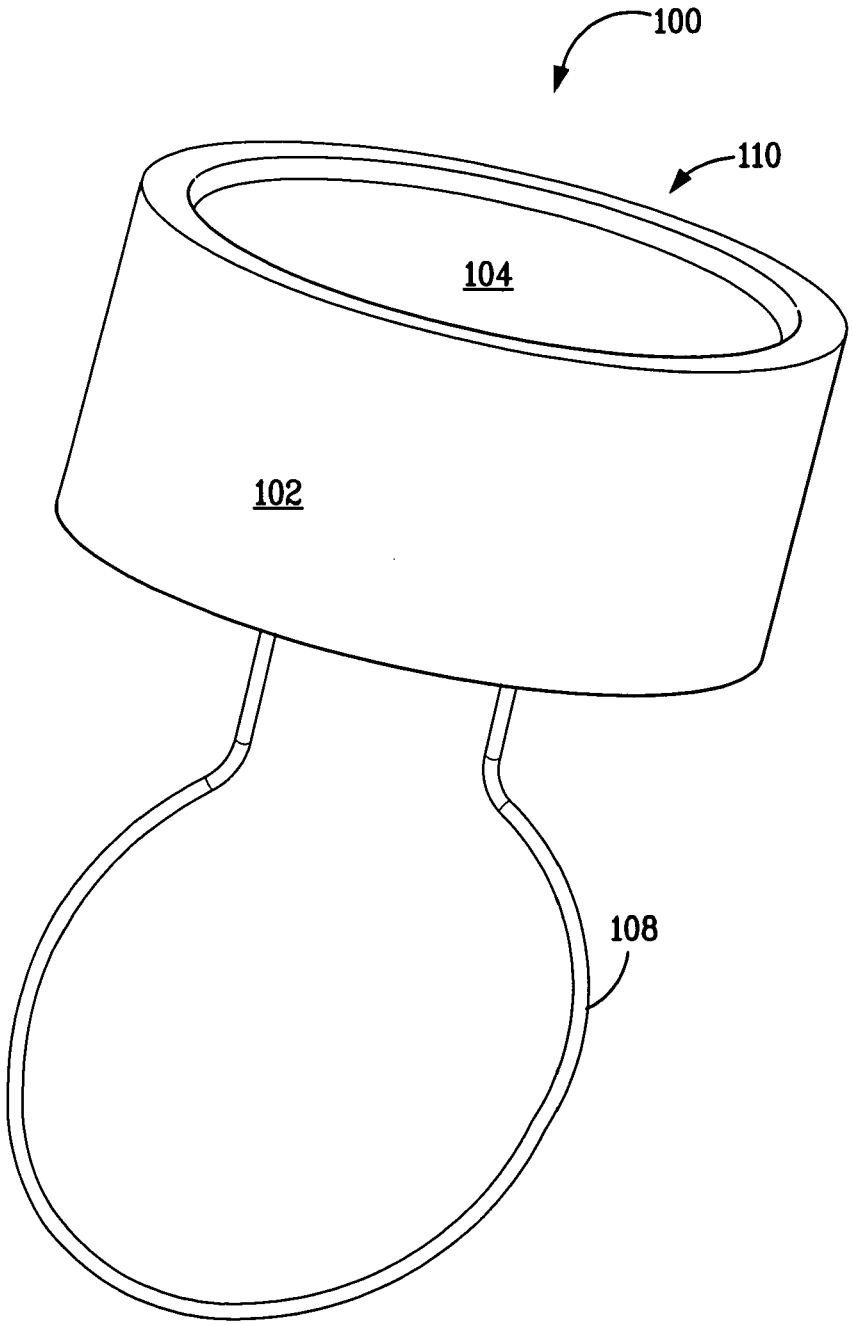
FIG. 8 is an overall view of the embodiment of a seal from FIG. 1, in an assembled state.

FIG. 8 is an overall view of the embodiment of a seal from FIG. 1, in an assembled state. In the assembled state, a portion (e.g. loop) of wire 108 extends beyond the exterior of the seal 100, with both ends of the wire secured within the body 102. In this example, the plug 104 is contained fully within the recess 110 of the body 102 and the outer diameter of the plug 104 (e.g. portion120) is dimensioned to closely fit the inner dimension of the recess (e.g. sidewall 130) to hinder access to the snap ring within the assembly. It has additionally been found that flexible wire 108 can comprise a solid wire, a braided wire and/or either in combination with a tough polymeric coating. Use of a polymeric coating on the wire 108 can facilitate engagement of the serrations on the snap ring into the wire.

Figure 9:
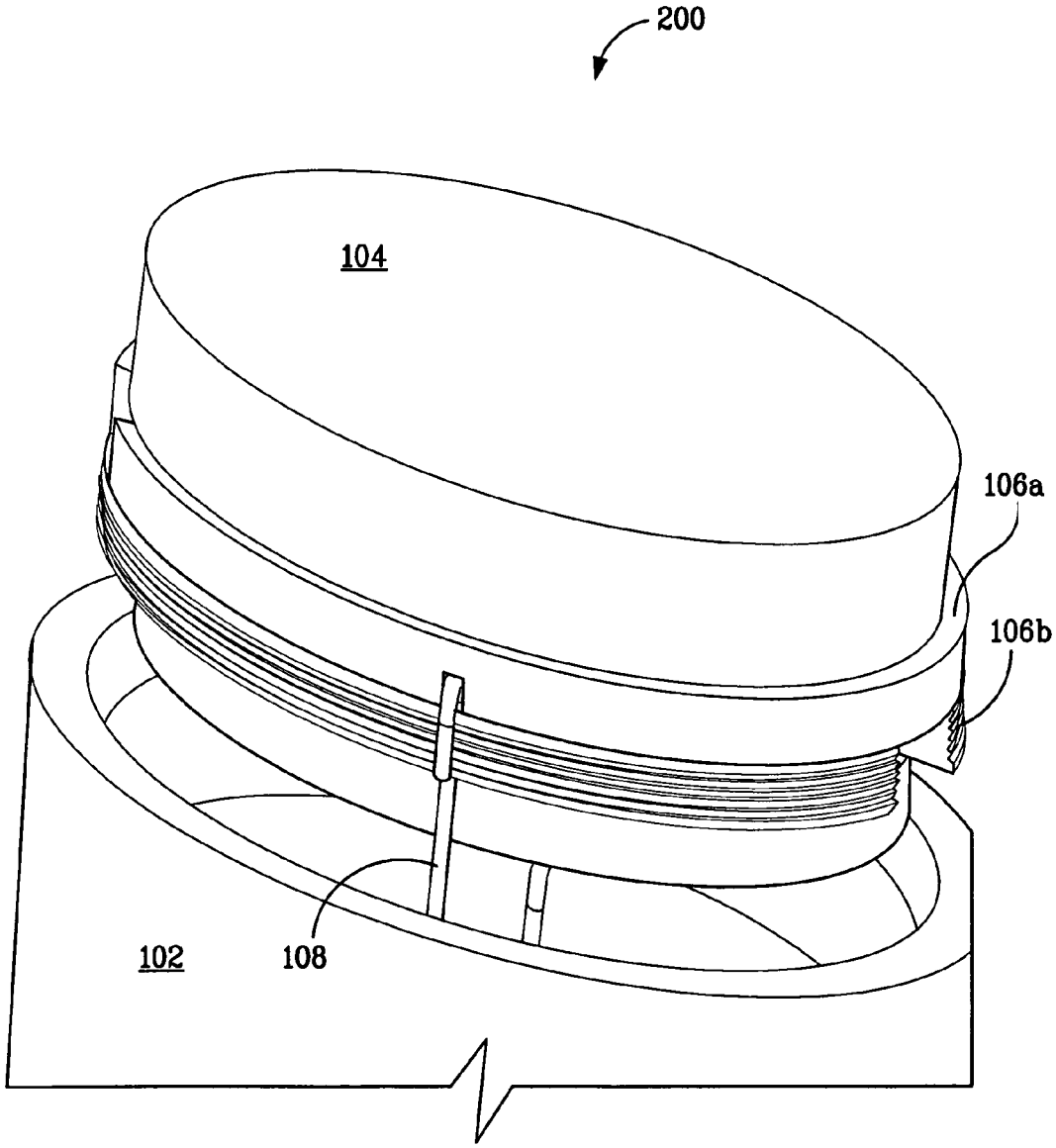
FIG. 9 is a schematic illustration of a partially assembled second embodiment of a seal according to the present invention.

FIG. 9 is a schematic illustration of a partially assembled second embodiment of a seal according to the present invention. In this exemplary embodiment of a seal 200, plug 104 is secured within recess 110 of body 102 by a snap ring comprising two components, "upper" snap ring 106*a* and "lower" snap ring 106*b*. In the context of this example, the terms "upper" and "lower" are used to simply distinguish the two components, and do not denote a required orientation. The use of two snap rings in the present embodiment can be beneficial in preventing access and tampering to a lower snap ring 106*b* having serrations about its outer diameter and therefore securing the ends of wire 108 within the body of the seal, by the presence of the upper 106*a* snap ring (e.g. "blocking ring") not necessarily having serrations about its outer diameter.

Figure 10:
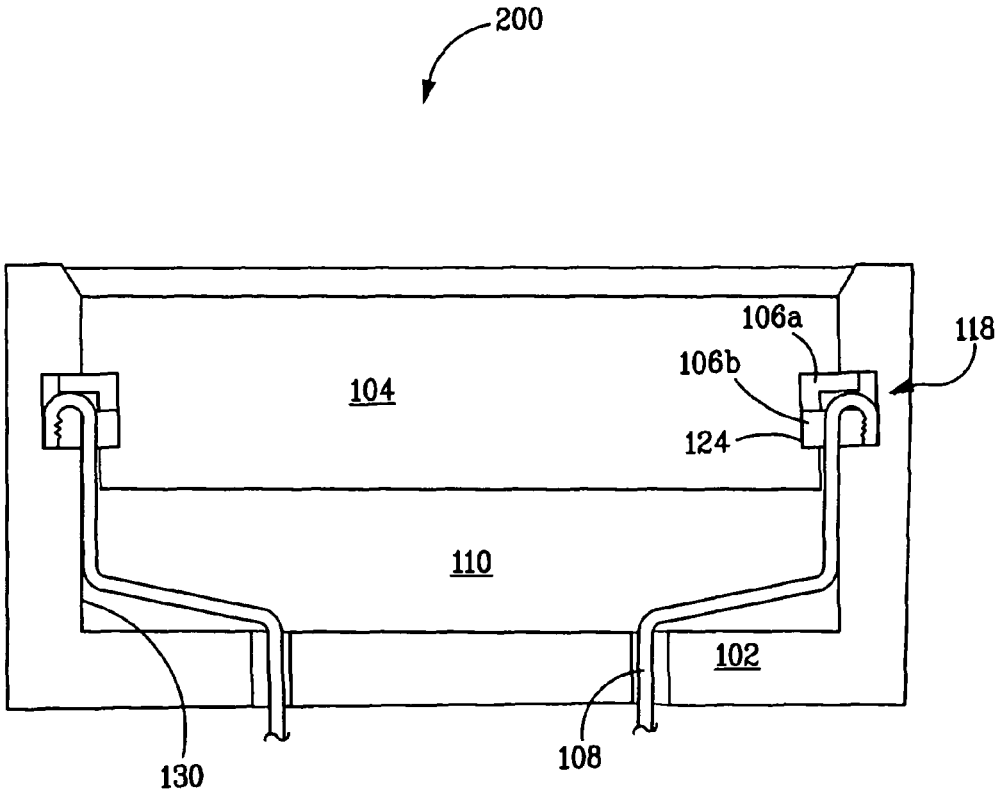
FIG. 10 is a cross-sectional view of the second embodiment of a seal from FIG. 9.

FIG. 10 is a cross-sectional view of the second embodiment of a seal from FIG. 9. In the present example, upper snap ring 106*a* and lower snap ring 106*b* are dimensioned (i.e. for convenience) to fit securely within the space formed by groove 118 within the recess 110 of body 102 and the groove 124 formed within the plug 104. In other embodiments of seals according to the present invention, upper and lower snap rings 106*a* and 106*b* could be spaced apart, i.e. provided with individual sets of grooves in the recess 110 and the plug 104. For example snap ring grooves can be provided in both the upper 120 and lower 122 portions (see FIG. 2) of a plug 104 having differing outer diameters with corresponding grooves and diameter portions imparted to the sidewall 130 of the recess 110.

Figure 11:
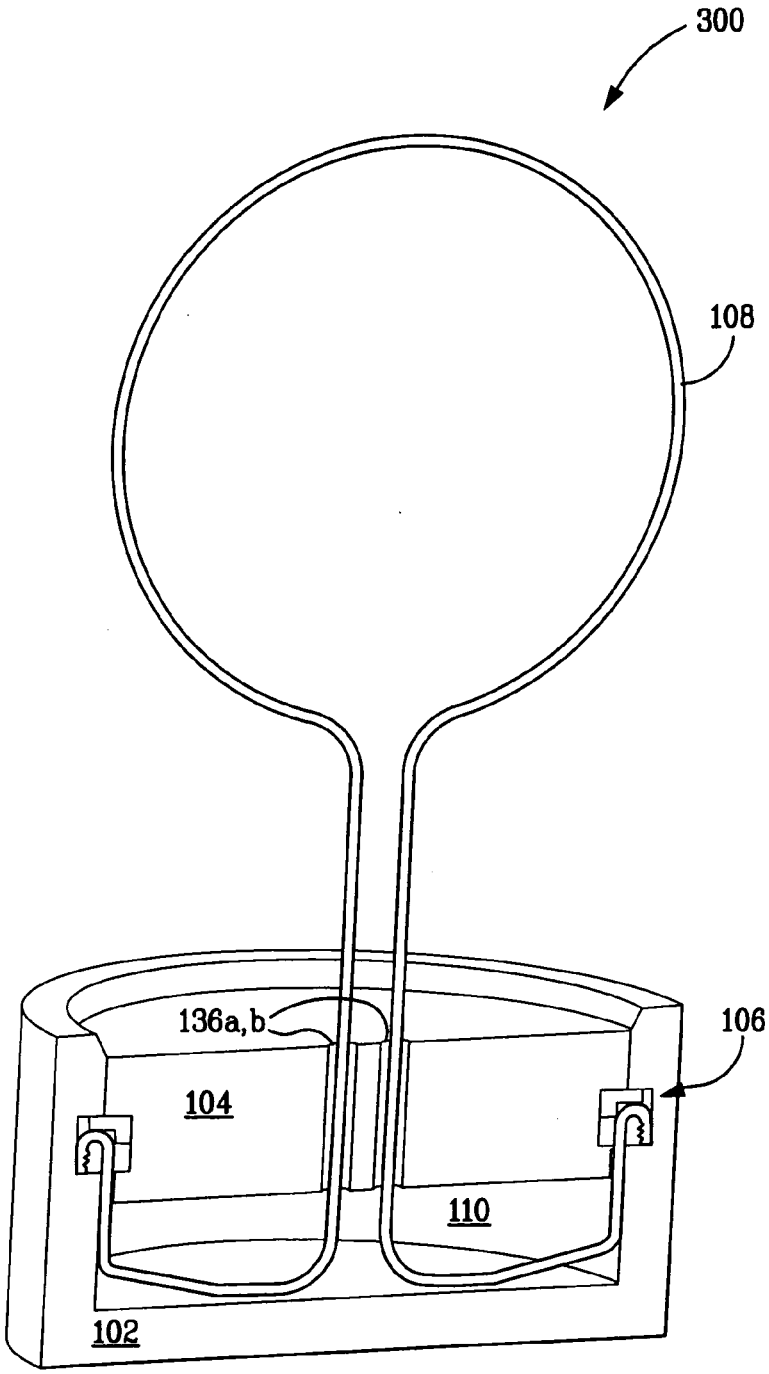
FIG. 11 is a schematic illustration of a third embodiment of a seal according to the present invention.

FIG. 11 is a schematic illustration of a third embodiment of a seal according to the present invention. In this exemplary embodiment, seal 300 comprises a plug 104 secured within recess 110 of body 102 by one or more snap rings 106, at least one of the snap rings comprising serrations about its outer diameter dimensioned to capture and securely hold the ends of the wire 108 within the body 102 (as described above). In this exemplary embodiment, plug 104 is provided with access holes 136*a,b* to allow threading the wire 108 from the exterior of the seal into the recess 110. As above, the ends of the wire 108 are passed through through-holes in the snap ring(s) 106, and the ends of the wire folded over the serrations on the snap ring(s) 106. Assembly of the seal 300 thereby capturing the ends of the wire 108 within the body of the seal.

Figure 12:
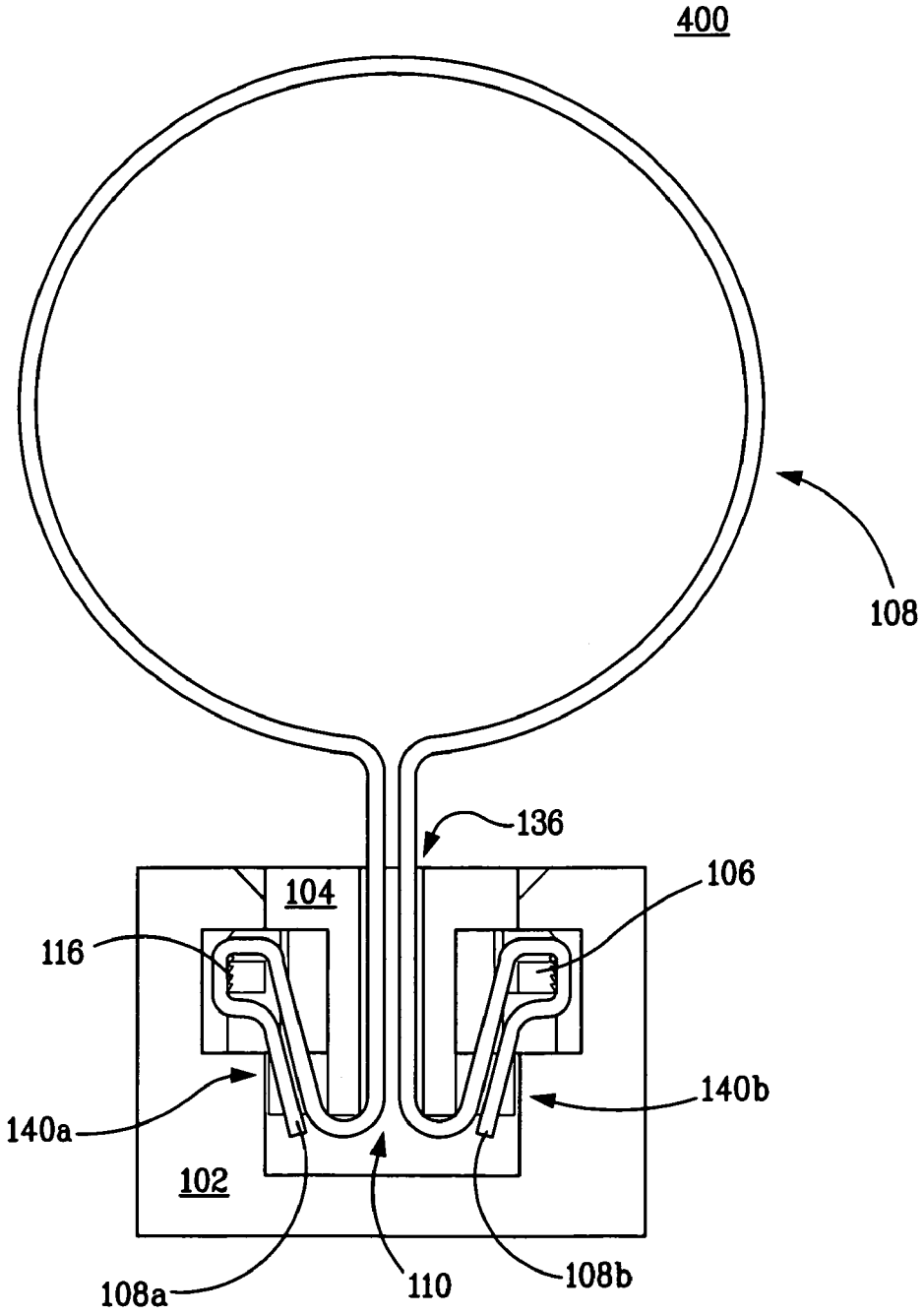
FIG. 12 is a schematic illustration of a fourth embodiment of a seal according to the present invention.

FIG. 12 is a schematic illustration of a fourth embodiment of a seal according to the present invention. In this exemplary embodiment, seal 400 includes a wire 108 having ends 108*a,b* that are passed through a common access hole 136 in the plug 104 into recess 110 within the body 102. In this embodiment, the wire ends 108*a,b* can be folded over serrations 116 on snap ring 106 and by means of additional clearance notches 140*a,b* disposed in the plug 104, re-enter recess 110.

Figure 13:
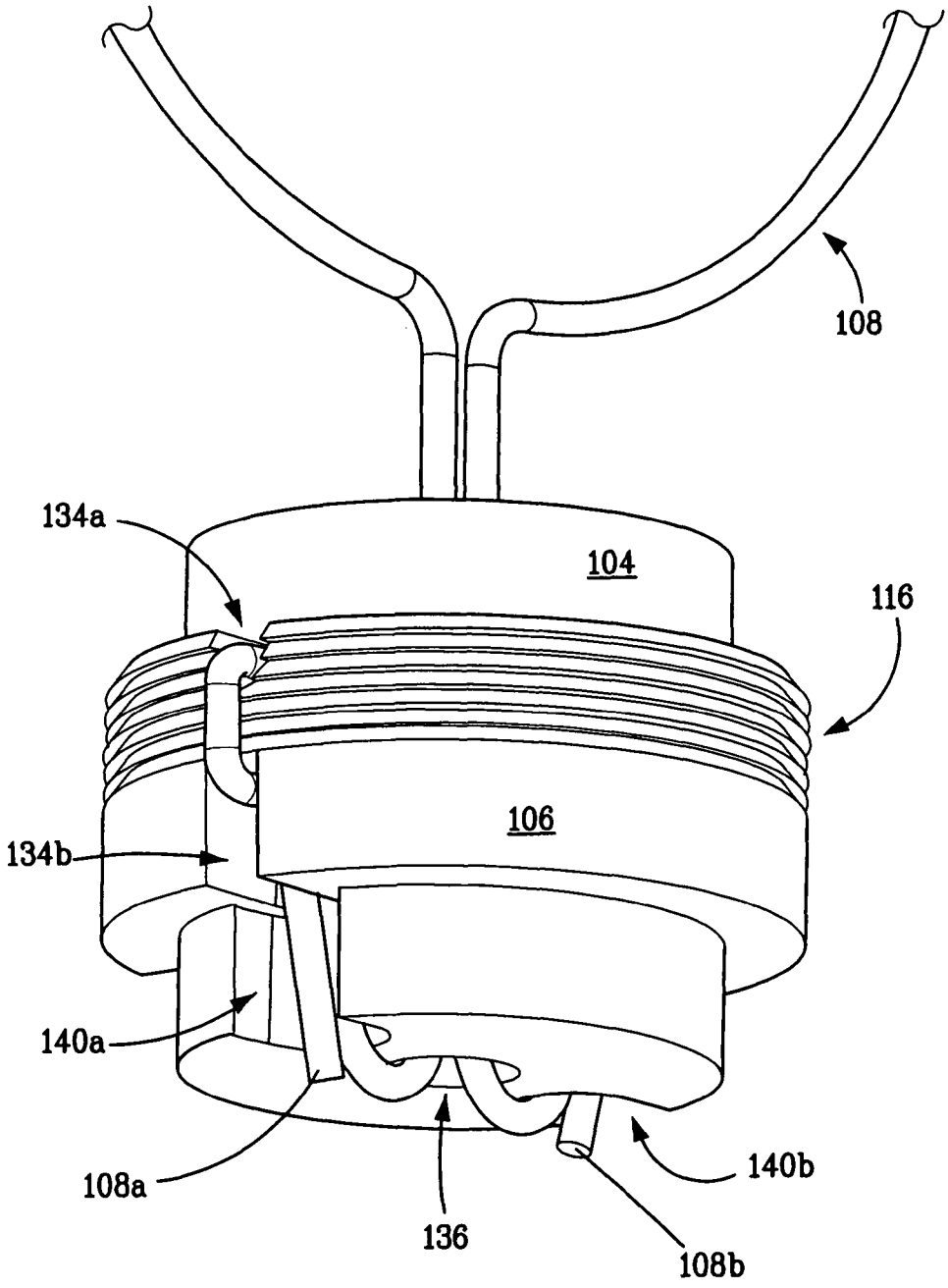
FIG. 13 is a schematic detailed illustration of a partially assembled fourth embodiment of a seal from FIG. 12.

FIG. 13 is a schematic detailed illustration of a partially assembled fourth embodiment of a seal from FIG. 12. By providing additional clearance notches 140*a,b* in the plug 104, wire ends 108*a,b* are easily accessible to an operator assembling the seal, which can facilitate drawing the wire taught prior to assembly. While not necessary, this can help to ensure wire 108 is securely captured by serrations 116 upon assembly of the seal 400. It should be noted that the additional clearances 140*a,b* could as well be provided in the body 102 of the seal. This embodiment also illustrates that the wire 108 can be threaded through a common access hole 136 as well as through separate access holes for each end of the wire, for example as illustrated in FIGS. 10 and 11.

Exemplary embodiments of seals according to the invention have been presented in which the various components (e.g. plug, body, snap ring grooves etc.) are dimensioned, or arranged, to provide a "close fit". It is believed that within the context of the present invention, the various ceramic, glass, glass-ceramic and/or polymeric piece parts can be manufactured in "as-fired" and/or "as-molded" condition of sufficient dimensional precision to insure a "close fit". In one exemplary non-limiting embodiment of a seal approximately 0.750" in outer diameter, it is reasonable to expect "as-fired" and/or "as-molded" tolerances to be approximately +/−0.010" which is more than adequate to achieve a close fit. It is additionally expected that seals according to the present invention are quickly and easy to assemble in the field without the need for special tools.

The above described exemplary embodiments present several variants of the invention but do not limit the scope of the invention. Those skilled in the art will appreciate that the present invention can be implemented in other equivalent ways. For example, the various modules and their functionality that make up the embodiments described above can be realized in many varied combinations of hardware and/or software. The actual scope of the invention is intended to be defined in the following claims.

What is claimed is:

1. A passive tamper indicating seal comprising:

a flexible wire having a length and first and second ends;

a body having a recess therein, the recess having a sidewall and a bottom surface, the sidewall having a groove therein, the groove extending at least partially around a perimeter of the sidewall, the body including at least one access hole, the at least one access hole operatively arranged to allow passing first and second ends of the wire from locations exterior of the body into the recess;

a plug insertable into the recess, the plug having a top surface, a bottom surface and a sidewall, the sidewall having a groove therein, the groove extending at least partially around a perimeter of the sidewall, the groove in the sidewall of the plug operatively arranged to be disposed opposite the groove in the sidewall of the recess when the plug is inserted into the recess; and, a snap ring having a top surface a bottom surface an inner diameter, a width, and a thickness, the width of the snap ring operatively arranged to be disposed partially within the groove in the plug and partially within the groove in the recess thereby securing an inserted plug to the body, the snap ring having first and second through-holes extending through the thickness of the snap ring, the first and second through-holes operatively arranged to allow the first and second ends of the wire to pass through the snap ring, the first and second ends of the wire further adapted to be foldable over the outer diameter of the snap ring, there being one or more serrations disposed on the outer diameter of the snap ring, the one or more serrations operatively arranged to compress the first and second ends of the wire folded over the snap ring against the sidewall of the recess, thereby securing the first and second ends of the wire within the body of the seal.

2. The seal of claim 1 wherein the body consists of one or more selected from a ceramic body, a glass body, a glass-ceramic body and, a polymer body.

3. The seal of claim 1 wherein the body comprises a transparent body.

4. The seal of claim 1 wherein the plug consists of one or more selected from a ceramic plug, a glass plug, a glass-ceramic plug and, a polymer plug.

5. The seal of claim 4 wherein the plug comprises a transparent plug.

6. The seal of claim 1 wherein the flexible wire comprises a polymer coated metal wire.

7. The seal of claim 1 wherein the snap ring further comprises one or more clearance notches disposed in one or more of the top surface and the bottom surface of the snap ring, each of the one or more clearance notches connected to a through-hole.

8. The seal of claim 1 wherein the sidewall of the recess further comprises a taper operatively arranged to facilitate insertion of the plug and snap ring into the recess.

9. The seal of claim 1 wherein the plug further comprises an upper portion having a first sidewall extending from the top surface and having a first diameter and, a lower portion having a second sidewall extending from the bottom surface and having a second diameter, the first diameter greater than the second diameter, the sidewall groove disposed between the upper portion and the lower portion.

10. The seal of claim 1 wherein the at least one access hole comprises an access hole disposed through the bottom surface of the recess.

11. The seal of claim 1 wherein the at least one access hole comprises an access holes disposed through the sidewall of the recess.

12. The seal of claim 1 wherein the recess and the plug further comprise at least one additional set of grooves operatively arranged to contain at least one additional snap ring.

13. The seal of claim 1 wherein the one or more serrations disposed on the outer diameter of the snap ring comprise a plurality of circumferentially extending teeth disposed on approximately one half the thickness of the snap ring.

14. The seal of claim 1 wherein the snap ring comprises one or more snap rings.

15. The seal of claim 1 wherein at least one of the body and the plug comprise an anti-counterfeiting feature consisting of one or more features selected from a unique distribution of embedded particles, a serial number and, a unique distribution of scratches.

16. The seal of claim 1 further comprising one or more additional clearance notches disposed on one or more of the body and the plug, the one or more additional clearance notches operatively arranged to allow the first and second ends of the wire to extend back into the recess after being folded over the snap ring.

17. A passive tamper indicating seal comprising:

a flexible wire having a length and first and second ends;

a body having a recess therein, the recess having a sidewall and a bottom surface, the sidewall having a groove therein, the groove extending at least partially around a perimeter of the sidewall;

a plug insertable into the recess, the plug having a top surface, a bottom surface and a sidewall, the top surface including at least one access hole, the at least one access hole operatively arranged to allow passing first and second ends of the wire from locations exterior of the seal into the recess, the sidewall of the plug having a groove therein, the groove extending at least partially around a perimeter of the sidewall, the groove in the sidewall of the plug operatively arranged to be disposed opposite the groove in the sidewall of the recess when the plug is inserted into the recess; and, a snap ring having a top surface a bottom surface an inner diameter, a width, and a thickness, the width of the snap ring operatively arranged to be disposed partially within the groove in the plug and partially within the groove in the recess thereby securing an inserted plug to the body, the snap ring having first and second through-holes extending through the thickness of the snap ring, the first and second through-holes operatively arranged to allow the first and second ends of the wire to pass through the snap ring, the first and second ends of the wire further adapted to be foldable over the outer diameter of the snap ring, there being one or more serrations disposed on the outer diameter of the snap ring, the one or more serrations operatively arranged to compress the first and second ends of the wire folded over the snap ring against the sidewall of the recess, thereby securing the first and second ends of the wire within the body of the seal.

18. The seal of claim 17 wherein the body consists of one or more selected from a ceramic body, a glass body, a glass-ceramic body and, a polymer body.

19. The seal of claim 18 wherein the body comprises a transparent body.

20. The seal of claim 17 wherein the plug consists of one or more selected from a ceramic plug, a glass plug, a glass-ceramic plug and, a polymer plug.

21. The seal of claim 20 wherein the plug comprises a transparent plug.

22. The seal of claim 17 wherein the flexible wire comprises a polymer coated metal wire.

23. The seal of claim 17 wherein the snap ring further comprises one or more clearance notches disposed in one or more of the top surface and the bottom surface of the snap ring, each of the one or more clearance notches connected to a through-hole.

24. The seal of claim 17 wherein the sidewall of the recess further comprises a taper operatively arranged to facilitate insertion of the plug and snap ring into the recess.

25. The seal of claim 17 wherein the plug further comprises an upper portion having a first sidewall extending from the top surface and having a first diameter and, a lower portion having a second sidewall extending from the bottom surface and having a second diameter, the first diameter greater than the second diameter, the sidewall groove disposed between the upper portion and the lower portion.

26. The seal of claim 17 wherein the recess and the plug further comprise at least one additional set of grooves operatively arranged to contain at least one additional snap ring.

27. The seal of claim 17 wherein the one or more serrations disposed on the outer diameter of the snap ring comprise a plurality of circumferentially extending teeth disposed on approximately one half the thickness of the snap ring.

28. The snap ring of claim 17 wherein the snap ring comprises one or more snap rings.

29. The seal of claim 17 wherein at least one of the body and the plug comprise an anti-counterfeiting feature consisting of one or more features selected from a unique distribution of embedded particles, a serial number and, a unique distribution of scratches.

30. The seal of claim 17 further comprising one or more additional clearance notches disposed on one or more of the body and the plug, the one or more additional clearance notches operatively arranged to allow the first and second ends of the wire to extend back into the recess after being folded over the snap ring.

* * * * *